US009326578B2

(12) United States Patent
Yoshidome

(10) Patent No.: US 9,326,578 B2
(45) Date of Patent: May 3, 2016

(54) HAIR CARE DEVICE

(75) Inventor: Akihiro Yoshidome, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 116 days.

(21) Appl. No.: 14/239,620

(22) PCT Filed: Jul. 27, 2012

(86) PCT No.: PCT/JP2012/069211

§ 371 (c)(1),
(2), (4) Date: Feb. 19, 2014

(87) PCT Pub. No.: WO2013/038820

PCT Pub. Date: Mar. 21, 2013

(65) Prior Publication Data

US 2014/0208605 A1 Jul. 31, 2014

(30) Foreign Application Priority Data

Sep. 16, 2011 (JP) ..... 2011-202725
Apr. 2, 2012 (JP) ..... 2012-083745

(51) Int. Cl.
*A45D 20/12* (2006.01)
*A45D 20/10* (2006.01)

(52) U.S. Cl.
CPC ..... *A45D 20/10* (2013.01); *A45D 20/12* (2013.01); *A45D 2200/202* (2013.01)

(58) Field of Classification Search
CPC ..... A45D 20/00; A45D 20/10; A45D 20/12; F26B 3/00; F26B 5/00; F26B 19/00; F26B 21/00; F26B 21/06; A21B 1/00; A21B 1/22
USPC ..... 34/95, 96, 97, 99, 100; 132/286, 313; 392/384, 385
See application file for complete search history.

(56) References Cited

U.S. PATENT DOCUMENTS

| | | | | | |
|---|---|---|---|---|---|
| 3,131,281 | A | * | 4/1964 | Jepson | 392/383 |
| 3,211,890 | A | * | 10/1965 | Graves | 392/385 |
| 3,386,184 | A | * | 6/1968 | Ponczek | 34/99 |
| 3,391,470 | A | * | 7/1968 | Chedister | 34/99 |
| 4,555,232 | A | * | 11/1985 | Raccah et al. | 432/222 |
| 4,939,345 | A | * | 7/1990 | Farina et al. | 392/384 |
| 5,394,620 | A | * | 3/1995 | Chimera | 34/97 |
| 5,394,777 | A | * | 3/1995 | Kozikowski | 83/15 |

(Continued)

FOREIGN PATENT DOCUMENTS

| | | | |
|---|---|---|---|
| EP | 2 002 752 B1 | | 7/2011 |
| GB | 2503519 | * | 1/2014 |

(Continued)

OTHER PUBLICATIONS

Official Communication issued in International Patent Application No. PCT/JP2012/069211, mailed on Oct. 30, 2012.

*Primary Examiner* — Stephen M Gravini
(74) *Attorney, Agent, or Firm* — Keating & Bennett, LLP

(57) ABSTRACT

A hair care device includes main body having a fan and a heater, a removable cover member configured to cover an opening of the main body, and a power supply cut-off part configured to cut off a power supply when the cover member is detached from the main body. As a result, safety is improved during attachment and detachment of components in the hair care device that require maintenance and replacement.

16 Claims, 16 Drawing Sheets

(56) References Cited

U.S. PATENT DOCUMENTS

| | | | | |
|---|---|---|---|---|
| 5,651,190 | A * | 7/1997 | Sanders | 34/99 |
| 5,873,178 | A * | 2/1999 | Johnson | 34/90 |
| 6,671,460 | B1 * | 12/2003 | Smal | 392/385 |
| 6,732,449 | B2 * | 5/2004 | Evanyk | 34/96 |
| 7,380,347 | B2 * | 6/2008 | Coats et al. | 34/97 |
| 8,245,630 | B2 * | 8/2012 | Houraney | 99/330 |
| 8,707,577 | B2 * | 4/2014 | Lee et al. | 34/97 |
| 2005/0091866 | A1 * | 5/2005 | Attaway et al. | 34/96 |
| 2007/0284356 | A1 * | 12/2007 | Findlay | 219/212 |
| 2014/0208605 | A1 * | 7/2014 | Yoshidome | 34/97 |
| 2015/0052773 | A1 * | 2/2015 | Thomas et al. | 34/99 |

FOREIGN PATENT DOCUMENTS

| | | | | |
|---|---|---|---|---|
| JP | 03244407 | A * | 10/1991 | A45D 20/10 |
| JP | 2008-307221 | A | 12/2008 | |
| WO | WO 2014/084335 | * | 6/2014 | |

* cited by examiner

HAIR CARE DEVICE

TECHNICAL FIELD

The present invention relates to a hair care device including a cover member for covering an opening in a main body of the hair care device, which cover member is removable for maintenance and replacement of parts installed within the main body of the hair care device.

BACKGROUND ART

Conventionally, in hair care devices, air taken in through a suction port is fed toward a discharge port by a rotating fan, and a filter is provided near the suction port in order to prevent dirt, dust, hair, and the like from being taken in through the suction port.

For example, Patent Literature (PTL) 1 discloses a hot air blower mounted with three filters between a suction port and a fan. Of the three filters, a first filter is provided at the suction port, and a second filter is provided within a main body of the hot air blower, with both filters being removable. The second filter has a lower aperture ratio than the first filter provided at the suction port, so as to be able to trap fine foreign matters. A third filter is fixed between the second filter and the fan so that in the case of removal of the first and second filters from the hot air blower, a finger or the like is prevented from contacting the rotating fan. In this manner, safety at the time of filter removal is ensured.

CITATION LIST

Patent Literature

PTL1: JP 2008-307221 A

SUMMARY OF THE INVENTION

Technical Problem

However, in the case where there are parts that require maintenance and/or replacement on a suction side (i.e., upstream side) of the fixed filter, or in the case where there are parts that require maintenance and/or replacement on a discharge side (i.e., downstream side) of a removable filter, for example, there is still a possibility of electric shock or personal injury in spite of the presence of the fixed filter if the maintenance/replacement is performed while the hot air blower is in an energized state.

Solution to Problem

The present invention has been made in view of the above, and aims at improving safety during an attachment/detachment operation of a part of hair care devices that requires maintenance/replacement.

An aspect of the present invention provides a hair care device including a main body having a fan and a heater; a removable cover member configured to cover an opening of the main body; and a power supply cut-off part configured to cut off a power supply when the cover member is detached from the main body.

The power supply cut-off part may be configured to cut off the power supply between a time at which a detaching operation of the cover member from the main body starts and a time at which the detaching operation is completed.

With the above arrangement, at the time of completion of the detachment of the cover member from the main body of the hair care device, power supply to components operating within the main body is cut off. This can reduce a risk of electric shock and/or injury of the user.

The power supply cut-off part may be configured to allow the main body to be energized upon attachment of the cover member to the main body.

With this configuration, the main body is placed in a condition for energization only by attaching the cover member to the main body after completion of a maintenance/replacement operation for a component, or part, installed within the main body. Thus, the maintenance/replacement operation will be less cumbersome to the user.

The hair care device may further include a detector configured to detect that the cover member has been attached to the main body. And, the power supply cut-off part may be configured to allow the main body to be energized after lapse of a certain time after the detector detects that the cover member has been attached to the main body.

With this configuration, the main body is not energized immediately after the cover member is attached to the main body. Thus, even if a hand of the user touches an energizing part and/or a heating part by mistake during an operation of attachment of the cover member to the main body, he or she may have leeway in releasing his/her hand from the part. This also can reduce a risk of electric shock and/injury of the user.

Further, the hair care device may further include an indicator configured to indicate an energized state of a component installed within the main body.

This configuration allows the user to check whether the inside of the main body is being energized or not when he or she is going to perform a maintenance/replacement operation upon components within the main body. Thus, the user can detach the cover member from the main body with a timing good for safety. As a result, a risk of electric shock and injury can be reduced.

The indicator may be configured to be changed in its indication state when the component becomes inoperative.

The component may be an ion generator configured to generate ions, and the ion generator may be arranged in a position in which the ion generator is exposed from the opening of the main body when the cover member has been detached from the main body.

Further, the hair care device may further include an ion detector configured to detect a quantity of ions generated by the ion generator, and the indicator may be configured to be changed in its indication state when the quantity of ions detected by the ion detector is below a predetermined value.

With these configurations, the user is allowed to know whether the ion generator has deteriorated. In addition, the user can see or view the ion generator by detaching the cover member from the main body, so that the maintenance/replacement operation for the ion generator becomes easier and the user's convenience or user-friendliness is improved.

The hair care device may further include a foreign matter blocking section arranged downstream of the fan and between the fan and the ion generator, and configured to block foreign matter from passing therethrough.

If foreign matter enters during the maintenance/replacement operation of the ion generator and if the hair care device is turned on by attachment of the cover member to the main body, the foreign matter blocking section blocks the foreign matter from passing into and through the fan. Therefore, failure of the hair care device can be suppressed.

Also, the hair care device may further include a rail along which the ion generator is slidable, a supporting part configured to secure the ion generator, and a spring configured to push the ion generator toward the opening of the main body when the ion generator is disengaged from the supporting part.

This configuration realizes easy removal of the ion generator when the user performs a maintenance/replace operation upon the ion generator. Also, when the user installs the ion generator in position, the supporting part secures the ion generator in position. Therefore, a DC connector inlet provided on the ion generator can be correctly connected. As a result, it is possible to prevent occurrence of failure of the device and/or fire, which might occur due to electrical leakage from the DC connector inlet if not connected properly.

The hair care device may further include a detachment mechanism due to which a detaching operation of the cover member from the main body takes time sufficient to allow the fan to completely stop rotating by a time at which the detaching operation of the cover member from the main body is completed.

The detachment mechanism may include a thread groove provided on each of the main body and the cover member, and allow the cover member to be detached from and attached to the main body by rotation of the cover member relative to the main body.

The detachment mechanism may include a rotation detector configured to detect rotation of the fan and a stopper configured to suppress the detachment of the cover member from the main body, and when the rotation detector detects that the fan has completely stopped rotating, the cover member may be disengaged from the stopper such that the cover member is allowed to be detached from the main body.

These configurations prevent dust, dirt, hair, or other substances from being taken in the main body by the fan that keeps rotating by inertia even after the power supply has been cut off in order for the user to detach the cover member.

The power supply cut-off part may include a switch having a magnet.

This arrangement enables not only the detachment of the cover member from the main body without providing a push switch, but also the shut-off of the power supply in junction with the detachment of the cover member. Thus, it is possible to reduce a risk of electric shock and injury of the user as well as reducing costs.

The power supply cut-off part may include a push switch. Use of the push switch makes the structure of the power supply cut-off part simpler because what is required is only that a part of the cover member presses a projecting part of the push switch.

A part or whole of the cover member may form an intake air filter. In this case, the maintenance/replacement of a component within the main body can be performed only by detaching the intake air filter. In this manner, the structure of the hair care device can be simpler.

Advantageous Effects of Invention

According to the present invention, it is possible to reduce the risk of electric shock or personal injury of a user during a maintenance/replacement operation of a part placed inside of the main body of the hair care device.

DESCRIPTION OF THE EMBODIMENTS

Hereinafter, embodiments of the present invention will be described with reference to the attached drawings.

<Embodiment 1>

Figure 1:
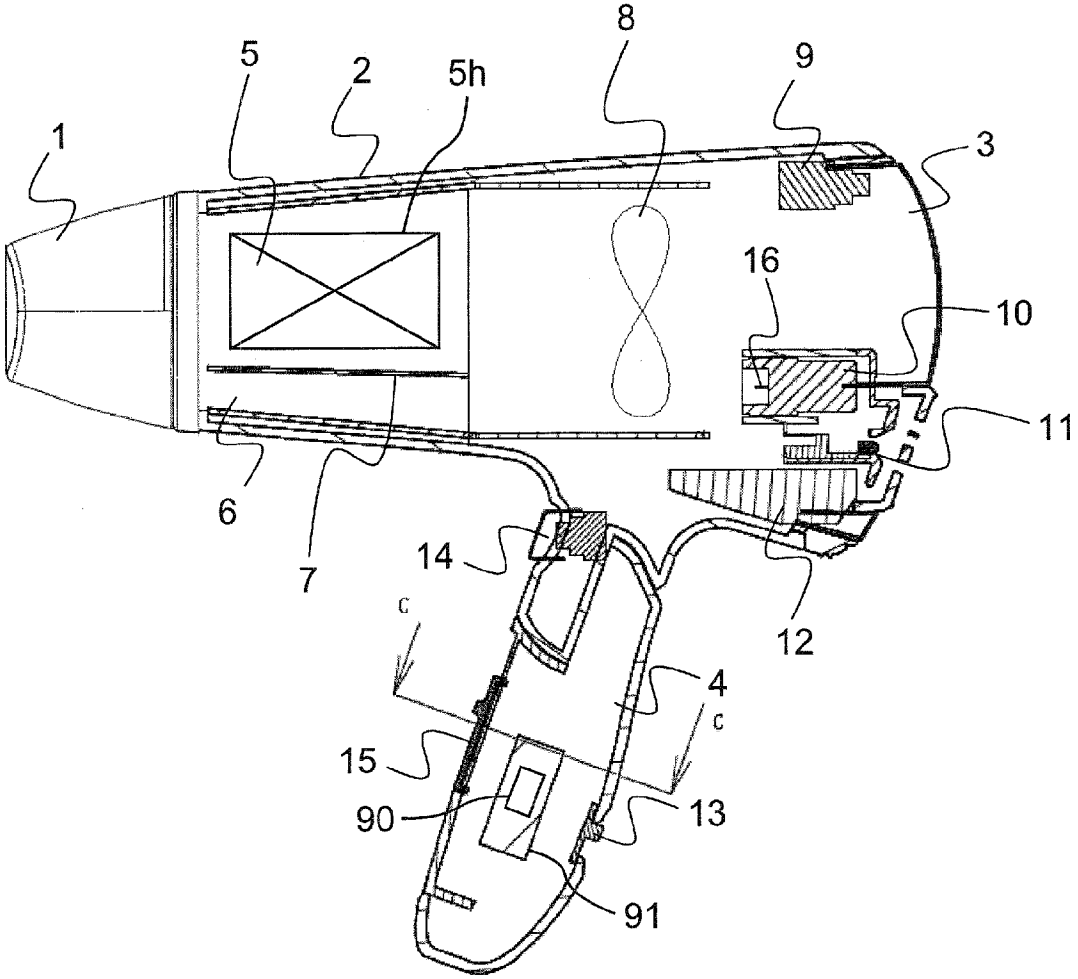
FIG. 1 is a see-through side view of a hair care device according to Embodiment 1 of the present invention.

FIG. 1 is a see-through side view of a hair care device according to Embodiment 1 of the present invention.

The hair care device of Embodiment 1 includes, as main components, a nozzle 1, a hair care device main body (hereinafter simply "main body") 2, an intake air filter 3 (which serves as a cover member), and a handle 4.

The nozzle 1 discharges air of the hair care device in a direction. The main body 2 houses a heating means, a blower means, and an electrical discharge means for emitting ions. The main body 2 further has a power supply cut-off means configured to disconnect a power supply by removing the intake air filter 3 from the main body 2. The intake air filter 3 is adapted to be installed in the main body 2. The intake air filter 3 and the power supply cut-off means are interlocked. The handle 4 includes a power on/off means and an air amount and temperature regulating means.

The main body 2 is provided with a hot air flow path 5 having a heater unit **5*h* as the heating means, and a cold air flow path 6 below a partition plate 7 to feed cold air. The main body also has a rotary fan 8, which serves as the blowing means, upstream of the hot air flow path 5 and the cold air flow path 6. Further, the main body 2 is provided with, upstream of the rotary fan 8, a push switch serving as the power supply cut-off means, an ion generator 10, an LED (light emitting diode) 11, and an ion generator board 12**.

Instead of the ion generator 10, a mist tank may be installed. Alternatively, both the ion generator 10 and the mist tank may be installed.

The handle 4 has, in addition to a power switch 15 to turn on and off a power supply, switches such as a switch 13 for selecting a "low temperature mode" and a turbo on/off switch 14 for turning on and off a turbo function to increase the air amount. The power switch 15 in the present embodiment has not only an on/off function but also three modes of "cool", "set" and "dry". In the "set" and "dry" modes, hot air is supplied due to the heater unit. If the "low temperature mode" is not selected, hot air of 75° C.-90° C. will be applied to hair and a scalp. However, when exposed to hot air in excess of 70° C. for a long time, the hair and scalp will be subject to damages, such as burns. Therefore, the hair care device of the present embodiment has the switch 13 to select the "low-temperature mode" which provides temperatures of 50° C.-60° C. that are gentle to the hair and scalp. Furthermore, the handle 4 contains an electronic component case that houses a microcomputer 90 to which signals are input from the various switches as mentioned above. In response to input signals, the microcomputer 90 controls the heater unit **5*h*, the ion generator 10, the LED 11, the motor for the rotary fan 8**, etc.

Figure 2:
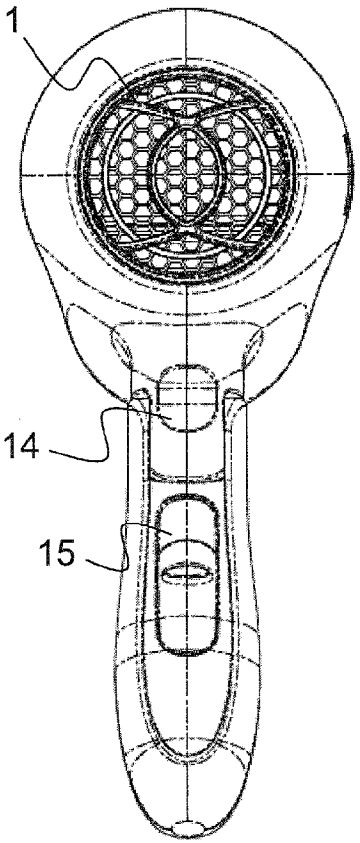
FIG. 2 is a front view of the hair care device according to Embodiment 1 of the present invention.

FIG. 2 is a front view of the hair care device according to this embodiment. A meshed lattice member as shown in the figure is provided upstream of a suction port of the nozzle 1 such that a user does not get burned by the heater unit **5*h*** in the main body.

Figure 3A:
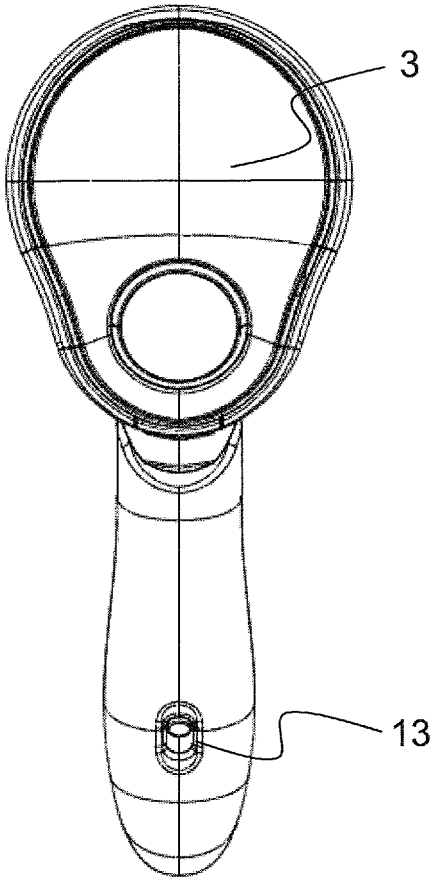
FIG. 3A is a rear view of the hair care device according to Embodiment 1 of the present invention, in a state that a cover member is attached.
Figure 3B:
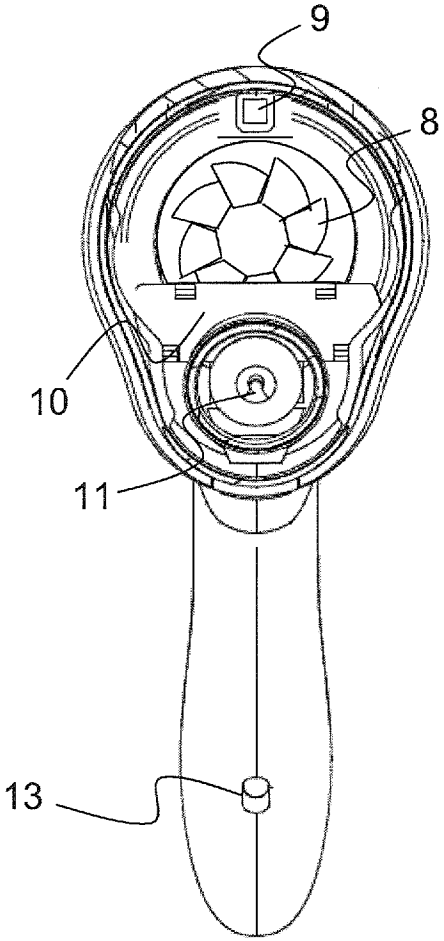
FIG. 3B is a rear view of the hair care device according to Embodiment 1 of the present invention, in a state that the cover member has been detached.

FIGS. 3A and 3B are rear views of the hair care device according to this embodiment. FIG. 3A shows a state that the intake air filter 3 is attached, while FIG. 3B shows a state that the intake air filter 3 has been detached. Once the intake air filter 3 is detached, the push switch 9, which was pushed by the intake air filter 3 until then, is released. The push switch 9 is interlocked with the power supply. The power supply is in an on state while the push switch 9 is in a pushed state. The power supply turns off when the push switch 9 is released from the pushed state. Thus, the detachment of the intake air filter 3 forcibly turns the power supply off, irrespective of the state of the power switch 15, and makes it possible to remove the ion generator 10 safely.

Figure 4A:
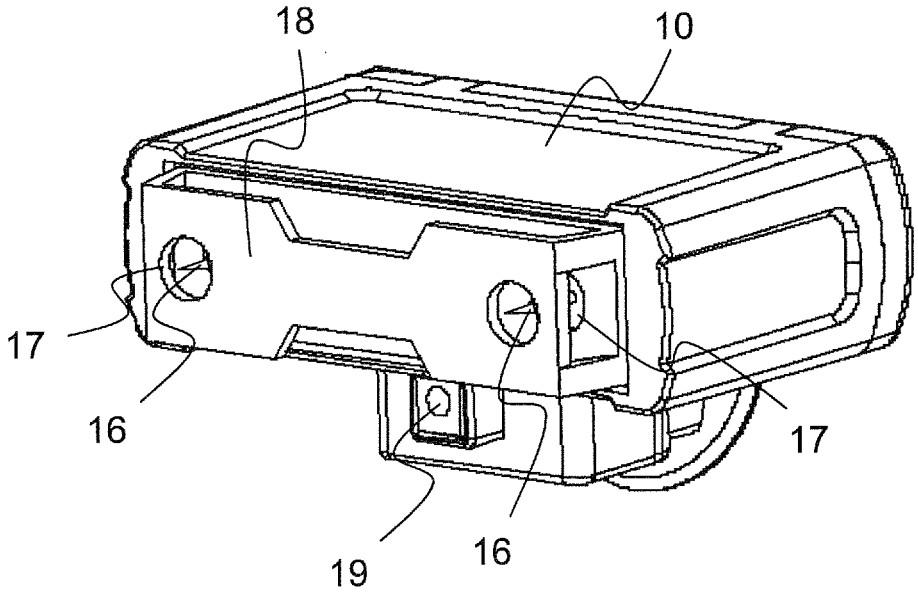
FIG. 4A is a perspective view of an ion generator in Embodiment 1 of the present invention, as viewed from a front side thereof.
Figure 4B:
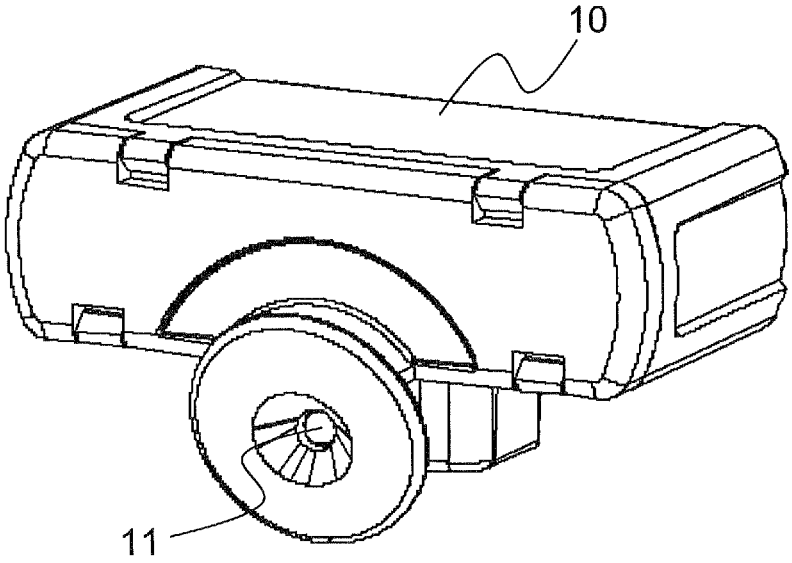
FIG. 4B is a perspective view of the ion generator in Embodiment 1 of the present invention, as viewed from a rear side thereof.

The ion generator 10 will be explained below. FIGS. 4A and 4B are perspective views of the ion generator when viewed from the front side and the rear side, respectively. The ion generator 10 has two ion generating sections each including a dielectric electrode 17 and a needle electrode 16. In each ion generating section, needle electrode 16 has a needle shape with a pointed tip, and the dielectric electrode 17 of a circular shape is disposed surrounding the needle electrode 16. A distance between these electrodes is 8 mm. The needle electrode 16 protrudes about 10 mm relative to the dielectric electrode 17. This arrangement allows for efficient harvesting of ions generated at the tip of the needle electrode 16. Because the needle electrode 16 is projected, a protection mechanism 18 is provided in front of the ion generating sections for safety such that the needle electrodes 16 are not touched directly.

Ions may be generated by, for example, applying an alternating current of 60 Hz with alternating effective voltages of +2 kV or higher and 0 V to the needle electrode 16 while applying the ground potential to the dielectric electrode 17. While the +2 kV or higher effective voltage is being applied to the needle electrode 16, corona discharge occurs due to a potential difference between the needle electrode and the dielectric electrode 17, and water molecules in the air are ionized in the vicinity of the tip of the needle electrode 16 to thereby produce hydrogen ions (H+). Furthermore, hydrogen ions are combined in a clustered manner with water molecules in the air (clustering), thereby producing positive ions of $H^+(H_2O)m$, where m is a natural number.

Negative ions may be generated by, for example, applying an alternating current of 60 Hz with alternating effective voltages of −2 kV or lower and 0 V to the needle electrode 16 while applying the ground potential to the dielectric electrode 17. These negative ions may be produced as follows. Oxygen ions $O_2$— are produced by ionization of oxygen molecules or water molecules in the air. The oxygen ions are clustered with water molecules in the air, resulting in negative ions consisting of $O_2$— $(H_2O)n$, where n is a natural number.

It is not necessary to specify ion species of the positive and negative ions, and may be any atoms or molecules charged positively or negatively. Also, it is not necessary to use both positive and negative ions, and only negative ions may be used for example.

According to the present embodiment, the ion generator 10 has two ion generating sections, which are a positive ion generating section and a negative ion generating section.

Thus, the positive ions and the negative ions are discharged therefrom at the same time, and flow in the downstream direction, carried by the airflow created by the rotary fan 8.

The electrodes 16, 17 are placed on the rotary fan 8 side of the ion generator. It is preferred that these electrodes be arranged so as to be directed perpendicular to the airflow, in other words, such that the needle electrodes 16 is directed upwards or downwards in FIG. 1. However, such an arrangement or layout may be less preferable for the ion generator 10 used in the present embodiment because such a layout of the ion generator 10 would block the suction port (intake air filter 3) due to that the ion generator 10 has an ion generating surface with the electrodes that is longer in a lateral or horizontal direction than in a vertical direction, and that the ion generator 10 has a large depth size in a direction in which the electrodes 16 extend. In view of this, in the present invention, the ion generator 10 is placed such that the electrodes 16, 17 are parallel to the airflow. Such a layout is a result of consideration of a quantity of ions generated and influences of dust through the experiments shown below.

Figure 5A:
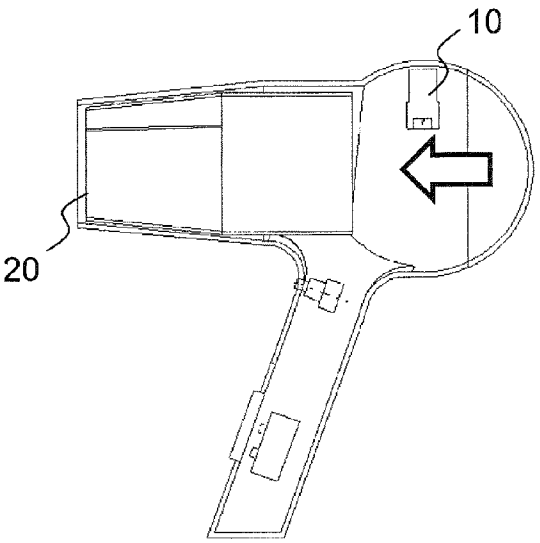
FIG. 5A shows an example of placement of the ion generator in Embodiment 1 of the present invention.
Figure 5B:
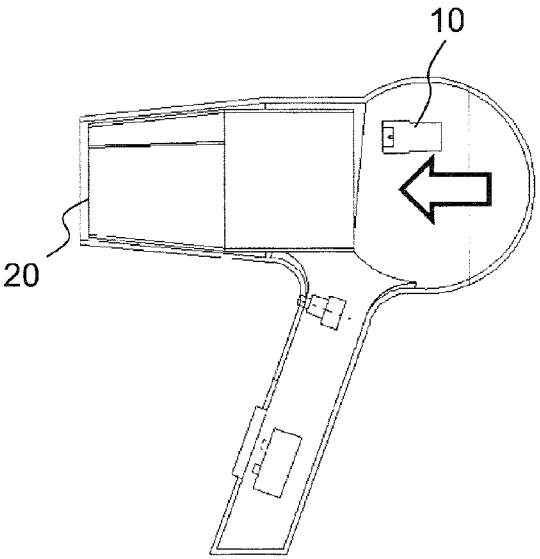
FIG. 5B shows another example of placement of the ion generator in Embodiment 1 of the present invention.
Figure 5C:
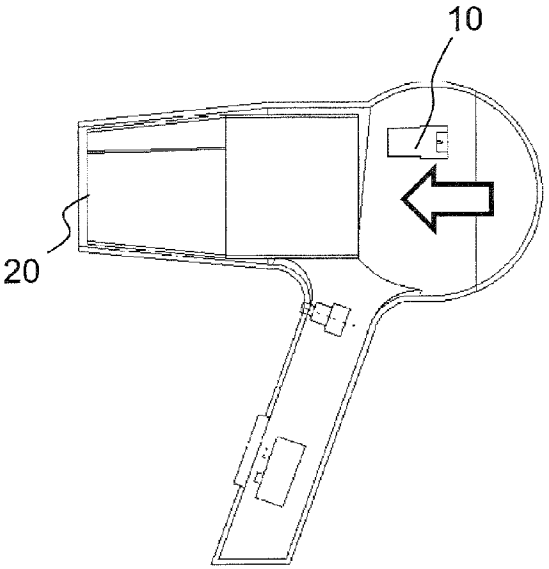
FIG. 5C shows a further example of placement of the ion generator in Embodiment 1 of the present invention.

FIGS. 5A, 5B, and 5C are illustrations showing different placements of the ion generator in prototype hair care devices. Quantities of generated ions discharged from a discharge port 20 were investigated regarding the three different placements of the ion generator as shown in FIGS. 5A-5C. This experiment was carried out to investigate the occurrence tendency of ions, using ion generators different from the one shown in FIGS. 4A and 4B. (For convenience, reference numeral 10 is attached also to the ion generator in FIGS. 5A-5C.) The quantities of generated ions are shown in Table 1 below.

With the placement of the ion generator 10 shown in FIG. 5A in which the electrodes extend perpendicularly to the direction of the airflow shown by an arrow, ions of between 950000/cc and 1200000/cc inclusive were discharged and the ion concentration in the air blown out of the device is the highest of the three placements. The experiment was carried out for a normal air volume (NORMAL) and an increased air volume (TURBO). In FIG. 5A the electrodes are directed downwards. However, similar results were obtained for the placement of the ion generator in which the electrodes are directed upwards.

FIG. 5B shows the placement of the ion generator in which the electrodes are arranged on the downstream side of the ion generator relative to the airflow direction. In this case, ions between 900000/cc and 1100000/cc inclusive, which quantity practically would raise no problem, were discharged from the discharge port 20.

FIG. 5C shows the placement of the ion generator in which the electrodes are arranged on the upstream side of the ion generator relative to the airflow direction. In this case, ions of between 950000/cc and 1050000/cc inclusive, which quantity practically would raise no problem, were discharged from the discharge port 20.

TABLE 1

| | | Ion Concentration (ions/cc) | |
|---|---|---|---|
| Ion Generator | Air Volume | Positive Ions | Negative Ions |
| FIG. 5A | NORMAL | 95 | 110 |
| | TURBO | 110 | 120 |
| FIG. 5B | NORMAL | 90 | 110 |
| | TURBO | 100 | 100 |
| FIG. 5C | NORMAL | 95 | 95 |
| | TURBO | 105 | 100 |

As is apparent, an enough quantity of discharged ions is obtained in each of the three placements. Thus, it may be preferable to place the ion generator 10 in such a manner that the suction port is not blocked or interrupted by the ion generator 10 as shown in FIG. 5B or 5C to thereby prevent reduction of the air volume. Among those, the placement of FIG. 5B may be most preferable because dust hardly settles directly onto the electrodes. In view of this, in the present embodiment, the ion generator 10 shown in FIG. 1 and other figures is arranged in accordance with the layout of FIG. 5B.

Preferably, the positive ions and the negative ions may be almost the same in number or the negative ions may be larger in number than the positive ions; the positive ions and the negative ions balanced in number can increase probability of generation of OH radicals, while a larger number of negative ions can prevent hair from getting less smooth or being damaged, for hair is positively charged.

Ions supplied downstream are blown toward hair through the discharge port 20. Hair is prone to be positively charged by brushing. But, negative ions prevent occurrence of static electricity and remedy damages of hair. Furthermore, due to application of ions combined with water molecules to hair, it is possible to infiltrate moisture into the hair by small water molecules of micro- or nano-level. As a result, a moisturized hair can be obtained.

Further, with use of the ion generator 10 of the present embodiment, positive and negative ions may be attached to the scalp. These positive and negative ions react with each other and produce OH radicals. The OH radicals oxidize dregs of a rinse or shampoo remaining on the scalp, which are obstacles to hair growth, and break the double bond. This helps improve the scalp into conditions good for hair growth. In this connection, OH radicals are so unstable that they can dwell only for nanoseconds. Therefore, if OH radicals were produced in the ion generator 10, they would disappear before they reach the scalp. In contrast, in the present embodiment, the ion generator 10 produces positive and negative ions so that these ions react on the scalp to effectively produce OH radicals on the scalp. The OH radicals also have sterilization and deodorization effects.

In the present embodiment, the ion generator 10 has an LED 11 placed at a rear lower portion thereof, as shown in FIG. 4B. The LED 11 is turned on when the hair care device is powered on and the components in the main body are energized (i.e., the LED 11 is on while the components in the main body are working). This helps the user know the state of the components inside the main body and check whether the hair care device is in operation or not, so that the user can consciously turn off the power and then remove the intake air filter 3. In this manner, it is possible to reduce the risk of electric shock or personal injury.

Figure 6A:
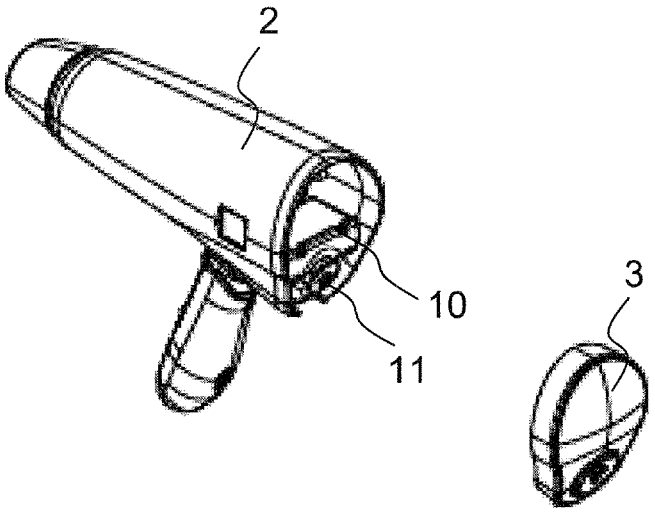
FIG. 6A is a perspective view showing how a part is removed from the hair care device according to Embodiment 1 of the present invention.
Figure 6B:
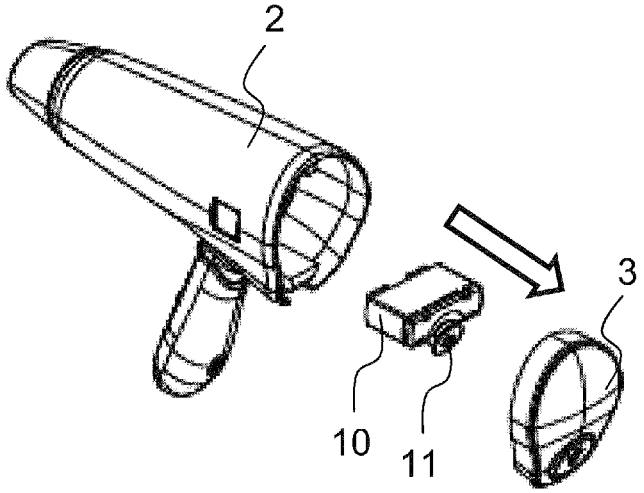
FIG. 6B is a perspective view showing how a part is removed from the hair care device according to Embodiment 1 of the present invention.

FIGS. 6A and 6B show perspective views of the hair care device of the present embodiment. The ion generator 10 may have a problem that if dust and/or foreign matter such as silicone contained in a hair spray is deposited on the needle electrode 16, the ion generation is reduced, so that the ions' effect cannot be obtained sufficiently. As a solution to the deposition of dust and/or silicone-based foreign matter onto the needle electrode 16, it is necessary to clean or replace the ion generator 10. FIG. 6A shows a specific configuration for removing from the main body 2 the intake air filter 3 which serves as a cover member.

Figure 7:
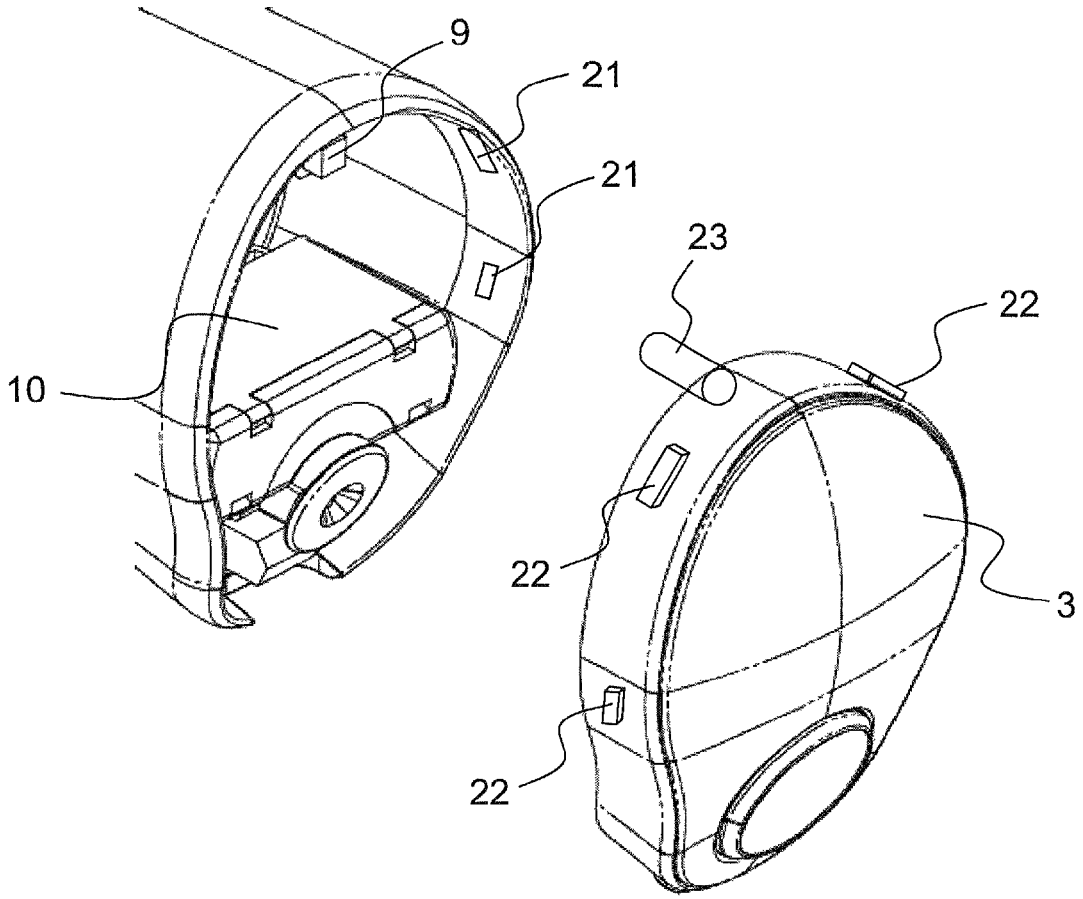
FIG. 7 is a perspective view showing a detachment mechanism between a main body and a cover member of the hair care device according to Embodiment 1 of the present invention.

FIG. 7 shows an enlarged view of a detachment section shown in FIG. 6A. In this embodiment, the intake air filter 3, which is a cover member, is fixed to the main body 2 by engagement between recesses 21 of the main body 2 and projections 22 of the intake air filter 3. The intake air filter 3 has a projecting rod 23. When the intake air filter 3 is attached to the main body 2, the push switch 9 is pressed by the projecting rod 23. In this way, only while the main body 2 is mounted with the intake air filter 3, the components inside the main body 2 can be energized. Therefore, if the user tries to turn on the power switch 15 to clean or replace the ion generator 10 while the intake air filter 3 is not on the main body of the hair care device, the components inside the main body are not energized and the danger such as electric shock can be prevented. In addition, because the detachment of the intake air filter 3 stops the operation of the rotary fan 8, it is possible to reduce introduction of dirt, dust, hair, etc. into the device after the detachment of the intake air filter 3. Therefore, unlike the device of PTL 1, a fixed filter should not necessarily be provided, so that cost reduction is expected. Furthermore, elimination of the fixed filter may increase the air amount.

According to the present invention, combining the separate main body 2 and intake air filter 3 together enables energization of the components. Therefore, alternatively, the hair care device may be configured such that attaching the intake air filter 3 after turning on the power switch 15 of the main body 2 allows the hair care device to start operating.

Alternatively, the hair care device may be configured such that attaching the intake air filter 3 after turning on the power switch 15 of the main body 2 makes the push switch 9 turn on, the microcomputer 90 detects the turning-on state of the push switch 9, and the hair care device is able to be energized after a time has passed since the microcomputer 90 detects the turning-on state of the push switch 9.

In such a case, the hair care device does not get energized immediately after the intake air filter 3 is attached to the main body 2. Therefore, even if the user touches an energized part or a heating unit by mistake when attaching the intake air filter 3, the user is allowed to have time to get his or her hand off of it. This reduces the risk of electric shock and/or injury that the user may undergo.

Also, according to the present invention, detachment of the intake air filter 3 and the ion generator 10 from the hair care device allows for cleaning of the rotary fan 8 and other maintenance operations.

Conventionally, there has been a problem that dirt, dust, hair, etc. not filtered off by an intake air filter adhere to a rotary fan of a hair care device due to static electricity. Thus, users have wished to clean the rotary fan installed within the main body of the hair care device. However, if the hair care device is configured such that the intake air filter is removable but there is no means for cutting off the power supply, there is a risk that the user may be injured by the intake air filter exposed by the detachment of the intake air filter. Furthermore, there may arise the problem that dirt, dust, hair, and/or the like is taken into the main body of the hair care device.

As a solution, it may be conceived that a removable second filter is placed between the intake air filter 3 and the rotary fan 8. With this arrangement, dirt, dust, hair, and/or the like, which cannot be captured by the intake air filter 3, can be captured by the second filter, and removal of the second filter allows for cleaning of the rotary fan 8. However, if the user removes the second filter without turning off the power supply, problems similar to the above problems arise. The problems can be solved by configuring the hair care device such that detachment of the intake air filter 3 makes the push switch 9 open to disconnect the power supply.

Referring now to FIG. 6B, removal of the ion generator 10 is shown as an example of maintenance/replacement of a component inside of the main body of the hair care device. In this embodiment, the ion generator 10 is integrated with the LED 11 as shown in FIG. 4B. The ion generator 10 has a projecting part around the LED 11 such that the ion generator can be removed from the main body, with the projecting part held by a hand and pulled out of the main body. The ion generator 10 is energized through connection between a DC connector on the main body and an inlet 19 (see FIG. 4A) on the ion generator.

<Embodiment 2>

Figure 8:
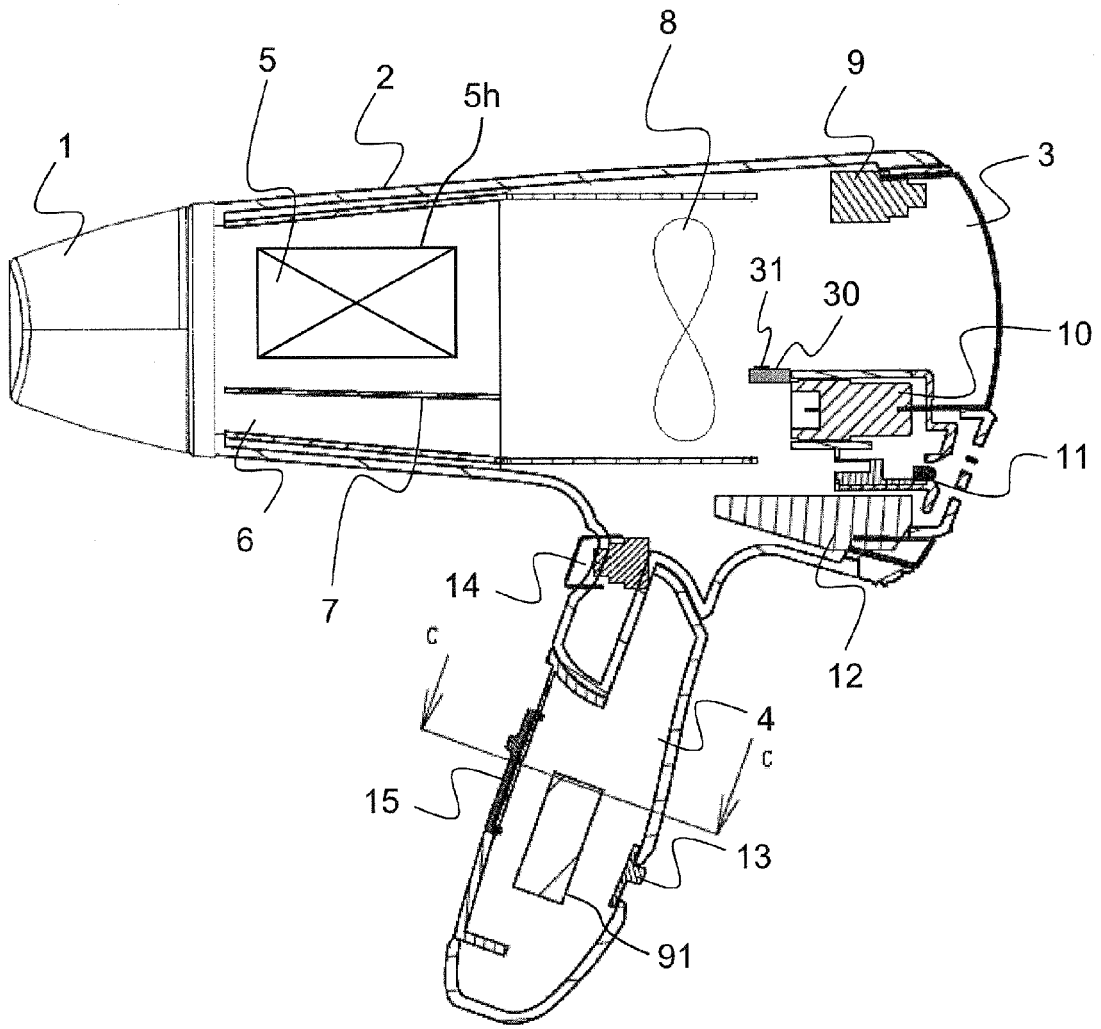
FIG. 8 is a see-through side view of a hair care device according to Embodiment 2 of the present invention, showing placement location of an ion generator.

FIG. 8 shows a see-through side view of a hair care device according to Embodiment 2. In FIG. 8, components same as or similar to the components shown in FIG. 1 are indicated by the same reference numbers as those in FIG. 1 and duplicate description will be omitted below. The structure of Embodiment 2 is same as the structure of Embodiment 1 except for the following. In this embodiment, the hair care device has an ion detector 30, which is placed at a downstream-side end of the ion generator 10. The ion detector 30 has a measuring part that is configured to measure an electrical potential of a collection electrode 31 for collecting ions in the air. The ion detector 30 is configured to detect negative ions based on the potential measured by the measuring part.

The collection electrode 31 may be a generally rectangular plate-like electrode adapted to collect or trap ions. The collection electrode 31 is placed immediately downstream of the ion generator 10 to mainly detect negative ions. An electrode surface of the collection electrode 31 confronts a flow path along which ions are sucked by the rotary fan 8. The measuring part has a resistor for pulling up the collecting electrode 31 to a certain positive potential, and a capacitor is connected in parallel with the resistor. Upon trapping negative ions, negative electric charge possessed by the ions charges the capacitor in a collection electrode circuit, so that a potential at a connection point (node) between the capacitor and the resistor decreases. Such a change in the potential is periodically measured and if an amount of change in the potential is less than a threshold, then it is determined that the negative ions are not released.

In the present embodiment, the LED 11 is utilized as an indicator of generation of ions. Specifically, a signal from the ion detector 30 is input into the microcomputer 90 (see FIG. 1) housed in the electric component case 91. Then, if the microcomputer 90 judges, based on the input signal from the ion detector 30, that the ion generator 10 does not generate the negative ions, the microcomputer 90 controls to turn off the LED 11 placed at a lower rear part of the ion generator 10 shown in FIG. 4B.

The ion generator 10 generates ions by corona discharge. A long-term use of the device may raise the following problems: metal ions may be emitted from the tip of the needle electrode 16 and the needle electrode 16 may be reduced; metal ions emitted from the needle electrode 16 may be deposited on the discharge electrode 17 in a sputtering deposition manner associated with the corona discharge, and give damages to the discharge electrode 17; or the ion generation may decrease due to cumulative deposition on the discharge electrode 17 of foreign matter such as chemical substances, dirt, dust, etc. As a result, the ion generator 10 may not function. However, ions are invisible, so that it is impossible to determine visually whether ions are being generated or not. Also, because the ion generator utilizes corona discharge, which is electrical discharge involving sound, a specific sound is emitted while corona discharge is taking place. However, while the corona discharge is taking place, the sound is emitted even without generation of ions. Thus, it is also difficult to aurally determine ions are being generated or not. This is why the sensor to detect a negative ion concentration is provided at a downstream end of the ion generator 10 inside of the main body 2 so as not to block the flow path for ions, and when the detected quantity of negative ions becomes less than a threshold, the LED is turned off.

An LED to indicate the state of the power supply of the hair care device may be provided along with the LED to indicate the ion detection result. Also, a plurality of LEDs may be used to indicate the power on and off states and ion detection states.

<Embodiment 3>

Figure 9:
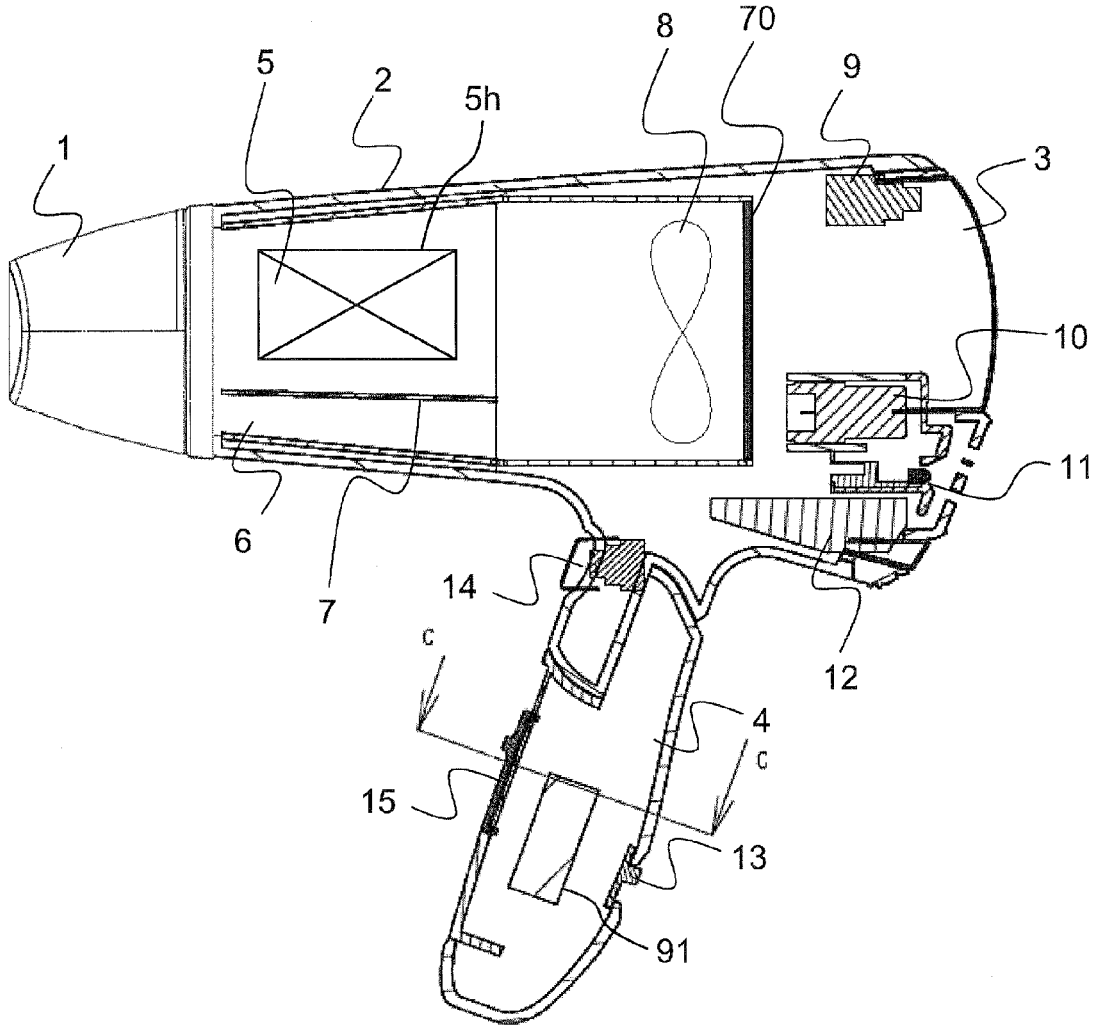
FIG. 9 is a see-through side view of a hair care device according to Embodiment 3 of the present invention, showing location of a foreign object blocking portion.
Figure 10A:
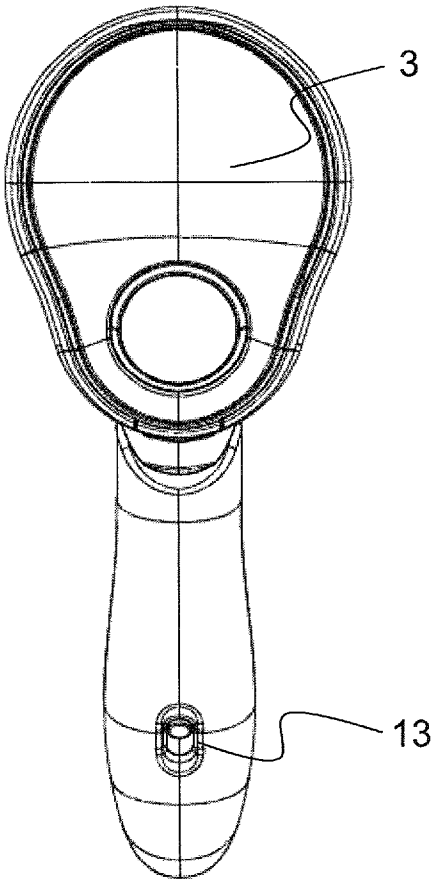
FIG. 10A is a rear view of a hair care device according to Embodiment 3 of the present invention, in a state that a cover member is attached.
Figure 10B:
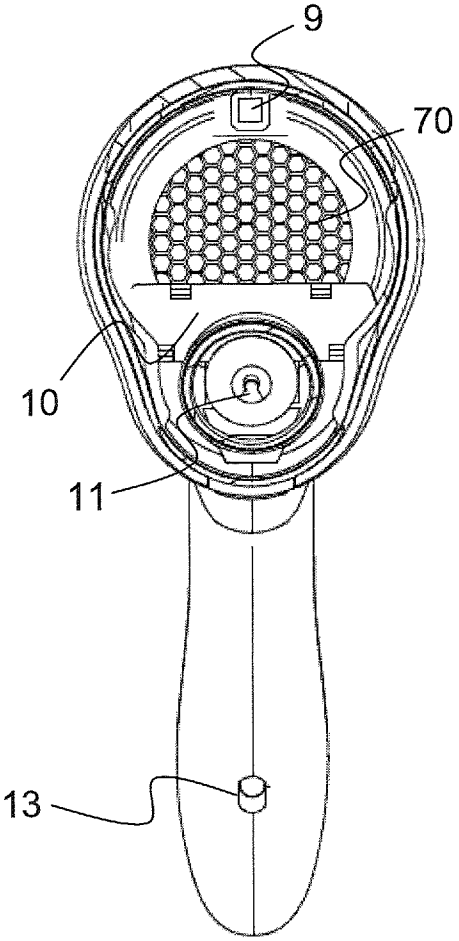
FIG. 10B is a rear view of the hair care device according to Embodiment 3 of the present invention, in a state that the cover member has been detached.

FIG. 9 shows a see-through side view of a hair care device according to Embodiment 3. In FIG. 9, components same as or similar to the components shown in FIG. 1 are indicated by the same reference numbers as those in FIG. 1 and duplicate description will be omitted below. FIGS. 10A and 10B are rear views of the hair care device according to Embodiment 3 of the present invention; FIG. 10A shows a state that the intake air filter 3 is attached, and FIG. 10B shows a state that the intake air filter 3 has been detached. Once the intake air filter 3 is detached, the push switch 9, which was pushed by the intake air filter 3 until then, is released, whereby the power is turned off. As shown in FIGS. 9 and 10B, a foreign matter blocker 70 is provided inside the main body and upstream of the rotary fan 8. The structure of this embodiment is same as the structure of Embodiment 1 except for the foreign matter blocker 70. This foreign matter blocker 70 may be provided in the hair care device of Embodiment 2 as well.

In the present embodiment, even when the intake air filter 3 is attached to the main body 2 in which foreign matter has been introduced during the ion generator 10 maintenance/replacement operation, and the power supply is then turned on, the foreign matter blocker 70 blocks the foreign matter from passing the rotary fan 8, so that failure of the hair care device is suppressed. Therefore, even if an infant detaches the intake air filter 3, puts a thing such as a rubber ball or a toy in the main body, and then attaches the intake air filter 3 with the thing kept in the main body, it is possible to prevent the thing such as the rubber ball or toy from becoming entangled with the rotary fan 8. Thus, immediate failure of the rotary fan 8 is prevented. Furthermore, fingers do not reach the fan due to the foreign matter blocker, and getting injured is thus suppressed.

<Embodiment 4>

Figure 11A:
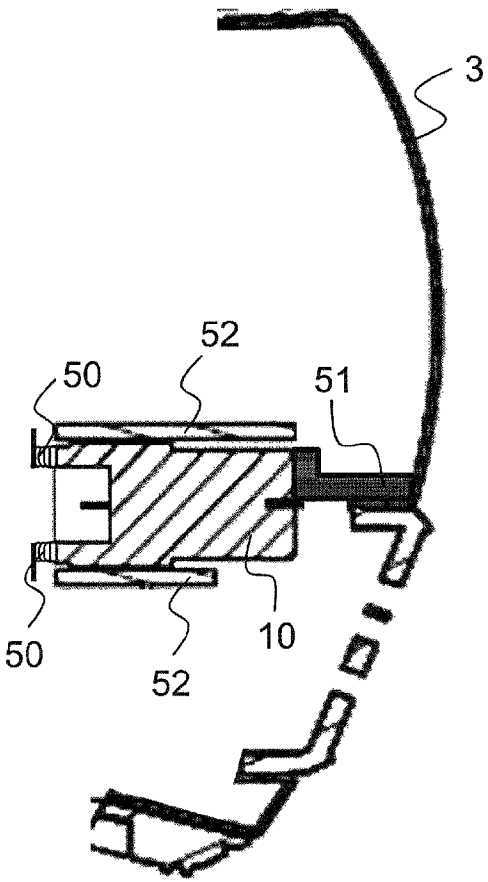
FIG. 11A is a see-through side view showing a detachment mechanism between a main body and a cover member of the hair care device according to Embodiment 4 of the present invention.
Figure 11B:
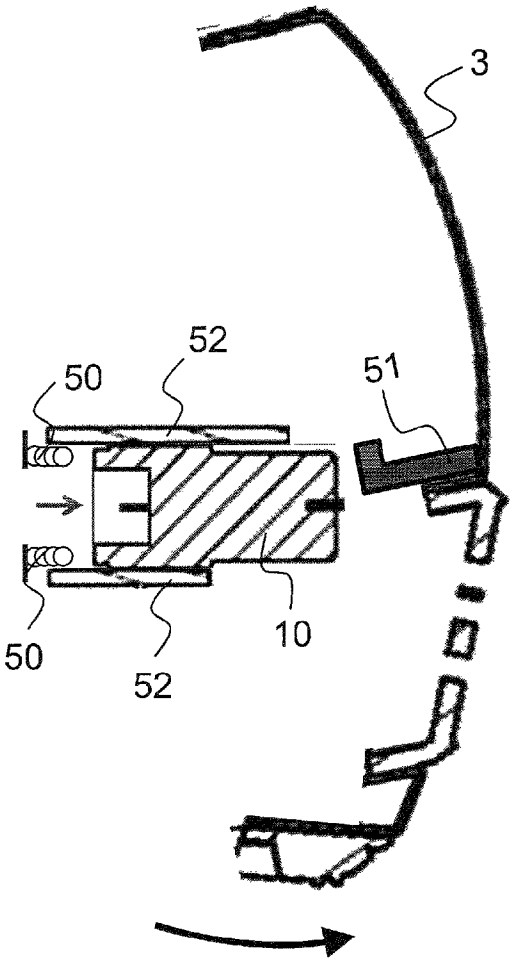
FIG. 11B is a see-through side view showing the detachment mechanism between the main body and the cover member of the hair care device according to Embodiment 4 of the present invention.
Figure 12A:
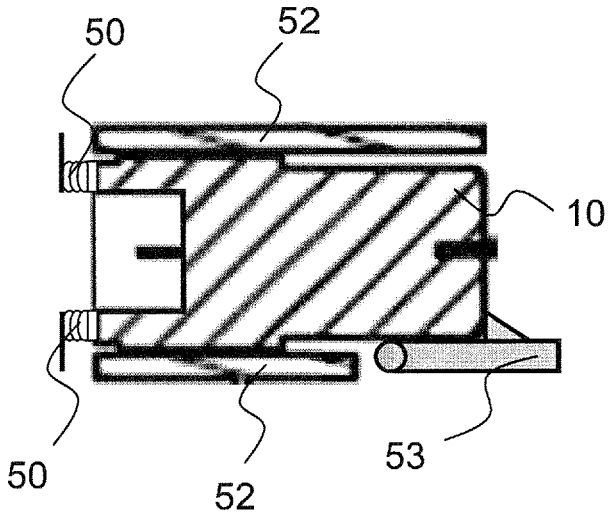
FIG. 12A is a side view showing a detachment mechanism of the ion generator in Embodiment 4 of the present invention, showing that an ion generator is placed in position within the main body of the hair case device.
Figure 12B:
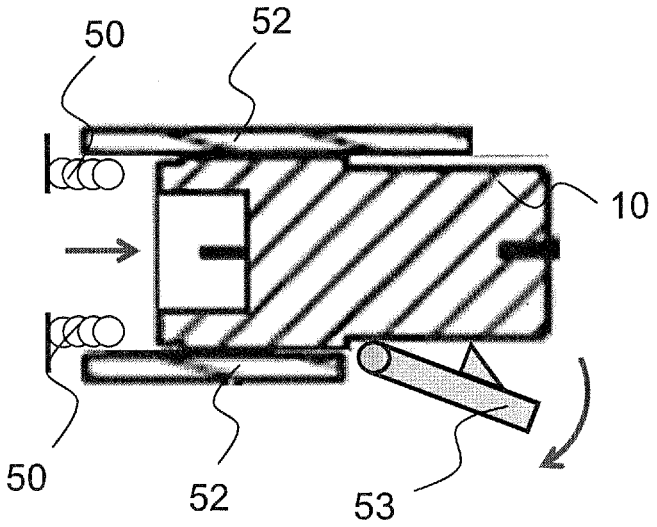
FIG. 12B is a side view showing the detachment mechanism of the ion generator in Embodiment 4 of the present invention, showing that the ion generator is being detached.

FIGS. 11A and 11*b* are see-through side views showing a detachment mechanism between the main body and the intake air filter 3, which is a cover member, of a hair care device according to Embodiment 4 of the present invention. FIGS. 12A and 12B are side views showing a detachment mechanism of the ion generator. Configuration and details shown in these figures may be applicable to any one of Embodiments 1-3 and any combination of these embodiments where it is appropriate or desired to do so.

This embodiment describes arrangements for attachment and detachment (removal) of the ion generator 10 in conjunction with the attachment and detachment (removal) of the intake air filter 3.

The ion generator 10 is configured to be detached from the main body 2 by the action of a spring 50, as shown in FIGS. 11A and 11B. The ion generator 10 is originally installed in the main body 2 as shown in FIG. 11A. In this embodiment, the spring 50 is placed in front of the ion generator 10 and kept compressed or contracted by the ion generator 10. Further, the ion generator 10 is pressed by a supporting part 51 which is fixed to the intake air filter 3. Detaching the intake air filter 3 in the direction of arrow in FIG. 11B causes the ion generator 10 to be pushed out by the force of expansion of the spring 50. In order to return the ion generator 10 to its original place, the ion generator 10 may be fitted between slide plates 52 serving as rails, followed by attachment of the intake air filter 3 to the main body.

In this manner, the hair care device allows for removal of the ion generator 10 in conjunction with the detachment of the intake air filter 3, with simple configuration. Thus, the user can easily perform the maintenance/replacement operation of the ion generator 10.

As an alternative, the ion generator 10 may be supported by a support claw 53, as shown in FIGS. 12A and 12B. Moving the support claw 53 in the direction of arrow shown in FIG. 12B allows the ion generator 10 to be pushed out by the force of expansion of the spring 50. In order to return the ion generator 10 to its original place, the ion generator 10 may be inserted toward the original place so as to be pushed against the spring 50, and the support claw 53 may be made to engage with a rear of the ion generator 10.

In installing the ion generator 10, it is necessary to insert the ion generator 10 to a position that allows the support claw 53 to engage with the rear of the ion generator 10. This arrangement allows the DC connector inlet 19 at the front of the ion generator 10 (see FIG. 4A) to be inserted deep over the DC connector. Thus, it is possible to prevent failure of the device and/or fire due to electrical leakage from the connection portion between the DC connector and the associated inlet of the ion generator 10.

<Embodiment 5>

Figure 13:
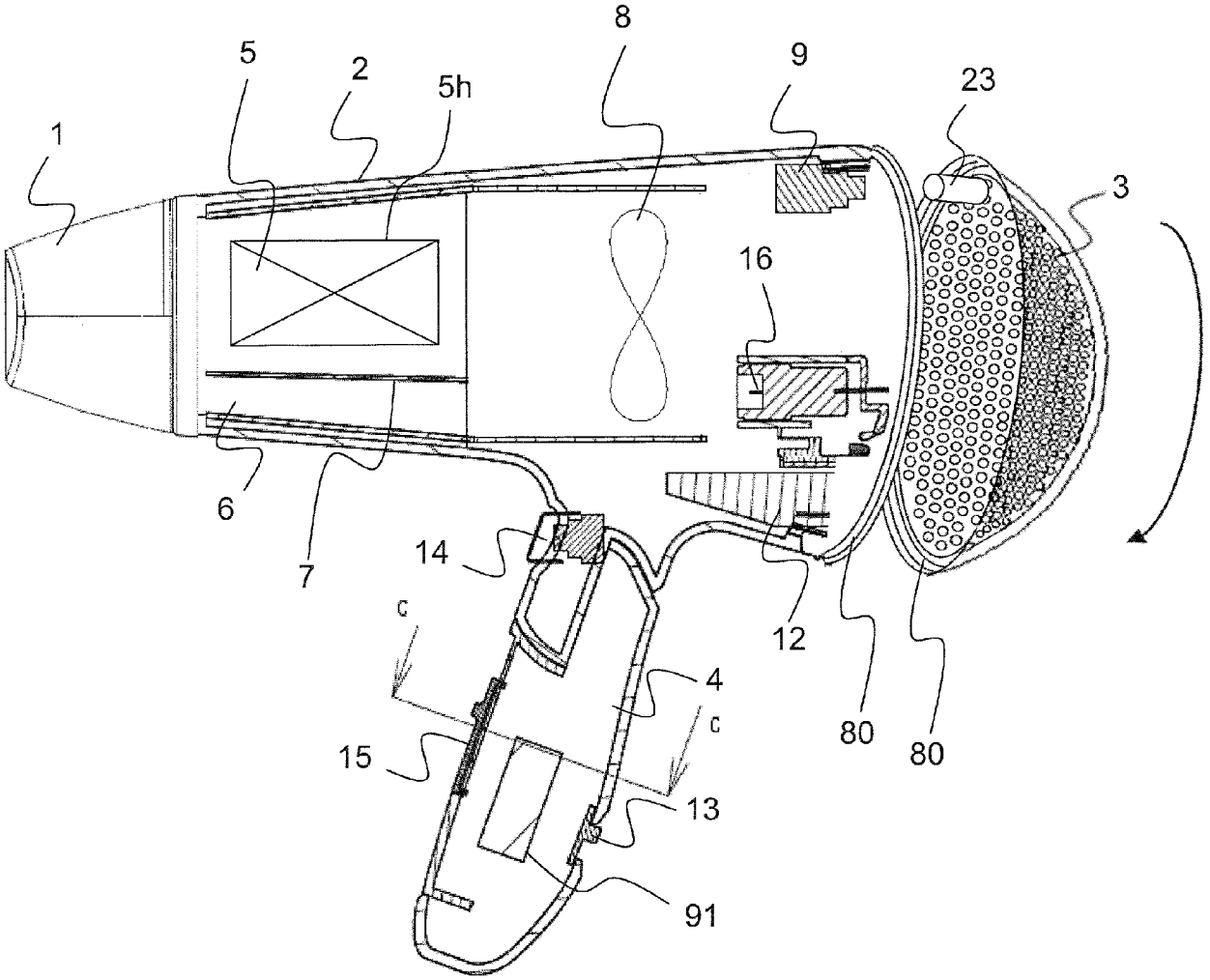
FIG. 13 is a see-through side view of a hair care device according to Embodiment 5 of the present invention.
Figure 14:
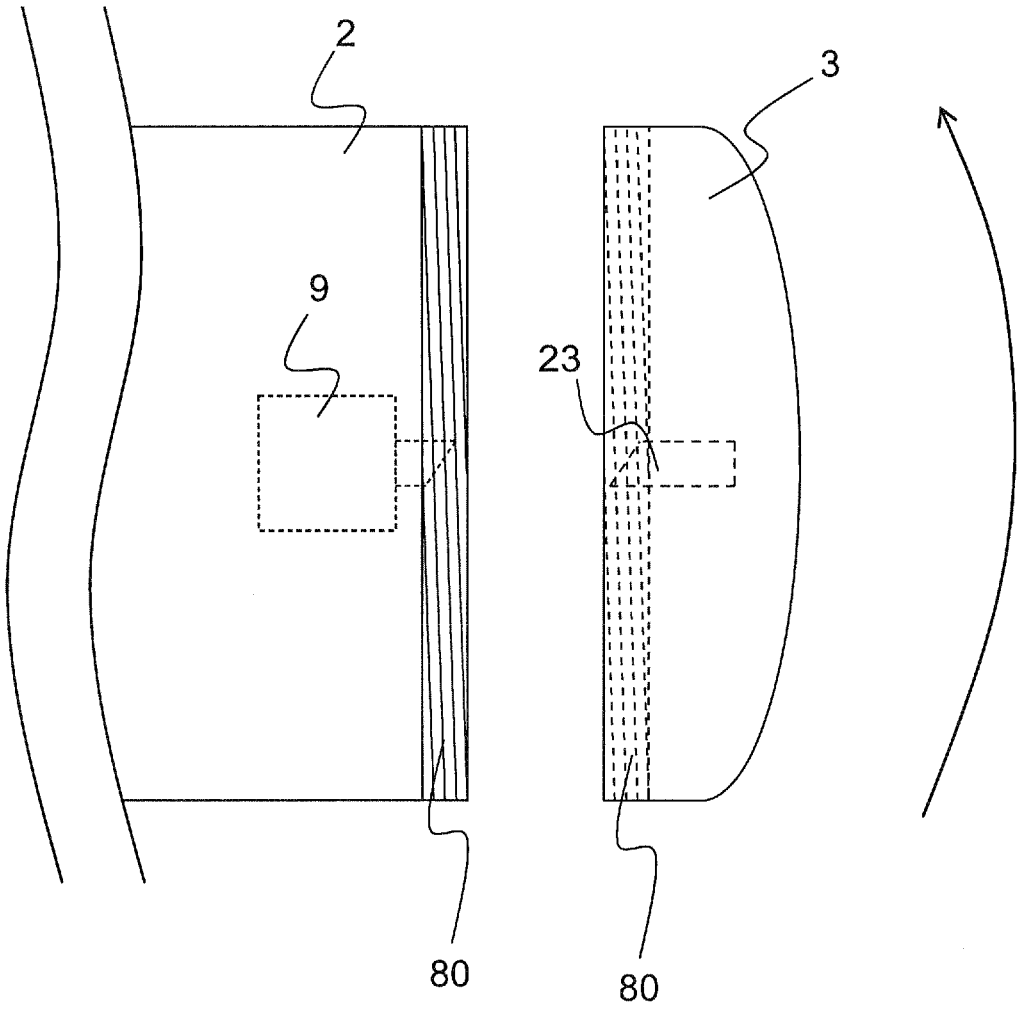
FIG. 14 is a see-through top view showing a detachment mechanism between a main body and a cover member of the hair care device according to Embodiment 5 of the present invention.

FIG. 13 is a see-through side view of a hair care device according to Embodiment 5. FIG. 14 is a see-through top view showing a detachment mechanism between the main body 2 and the intake air filter 3, which is a cover member, of the hair care device according to Embodiment 5. In FIG. 13, components same as or similar to the components shown in FIG. 1 are indicated by the same reference numbers as those in FIG. 1 and duplicate description will be omitted below. The structure of this embodiment is same as the structure of Embodiment 1 except for details that will be described below. However, the ion generator according to Embodiment 2 may be used.

When detaching the intake air filter 3 from the main body 2 as described in connection with Embodiments 1 and 4, after the power supply has been disconnected, the rotary fan 8 may rotate for about 1 second by inertia. Therefore, without the foreign matter blocker 70 between the intake air filter 3 and the rotary fan 8 as described in Embodiment 3, there still remains a risk, although slight, that the user touches the rotary fan 8. Further, there is a concern that when one removes the intake filter 3 before the rotary fan 8 stops rotating, substances such as dirt, dust, hair may be taken in the main body. Therefore, the hair care device of this embodiment is configured such that it takes about 1 second to remove the intake air filter.

For example, it may take about 1 second to entirely detach the intake air filter using thread grooves 80, as shown in FIG. 13. Furthermore, a time duration required for detachment is adjustable by adjusting the amount of thread groove 80. Referring to FIG. 14 which shows the main body 2 and the intake air filter 3 as viewed from above, the push switch 9 and the projecting rod 23 are provided with an oblique cut such that when attaching the intake air filter 3 to the main body 2 by rotating it, the projecting rod 23 for pushing the push switch 9 is smoothly placed into contact with the push switch 9.

Alternatively to the shown arrangement in which the thread groove 80 is provided on the entire circumference of the main body 2 and of the intake air filter 3, the hair care device may be configured as follows. That is, the intake air filter 3 may be partially rotatable by, for example, 45 degrees up to a position relative to the main body 2 and a claw on the intake air filter 3 may be slidable to the position where the intake air filter 3 stops, whereby the main body 2 and the intake air filter 3 can be disconnected from each other. Also, the rotary fan 8 may be made to completely stop rotating on or before the completion of the entire detachment of the intake air filter 3 from the main body 2. The structure of the detachment mechanism described in this embodiment is applicable to any one the above-mentioned embodiments or a combination of two or more of the embodiments where it is appropriate or desired to do so.

<Embodiment 6>

FIGS. 15A-15D are see-through side views showing a detachment mechanism between the main body 2 and the intake air filter 3, which is a cover member, of a hair care device according to Embodiment 6 of the present invention. Configuration and details shown in these figures may be applicable to any one of Embodiments 1-5 and any combination of these embodiments where it is appropriate or desired to do so. In this embodiment, the hair care device is configured such that torque of a motor 81 of the rotary fan 8 is detected and a stopper claw 60 is disengaged according to the detected torque to allow the intake air filter 3 to be detached after the rotary fan 8 completely stops rotating.

Figure 15A:
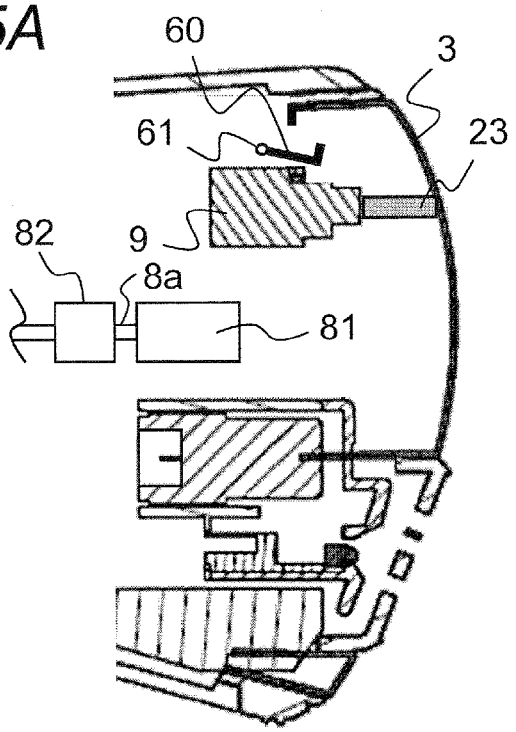
FIG. 15A is a see-through side view showing a detachment mechanism between a main body and a cover member of the hair care device according to Embodiment 6 of the present invention.

FIG. 15A shows the hair care device 1 in a de-energized state. In this state, the stopper claw 60 is directed downward relative to a rotation axis 61. That is, the stopper claw 3 is not engaged with the intake air filter 3. Thus, the intake air filter 3 can be detached.

Figure 15B:
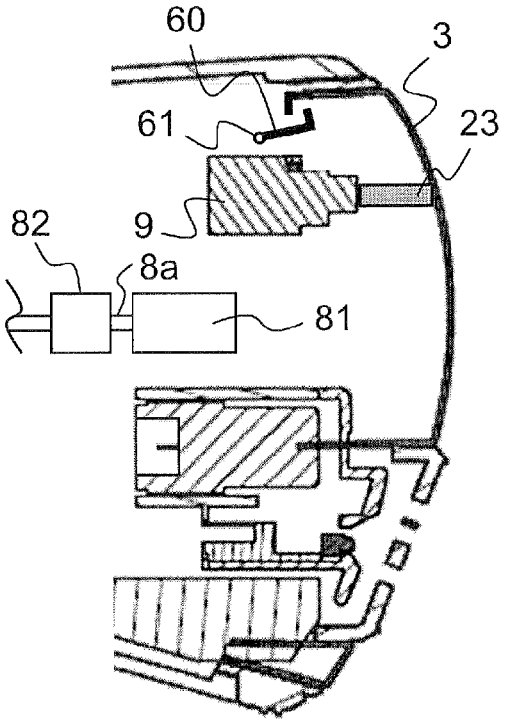
FIG. 15B is a see-through side view showing the detachment mechanism between the main body and the cover member of the hair care device according to Embodiment 6 of the present invention.

Upon powering on the hair care device 1, the stopper claw 60 rotates around the rotation axis 61 resulting in engagement of the stopper claw 60 with the intake air filter 3, as shown in FIG. 15B. Thus, the intake air filter 3 is prohibited from being detached. The stopper claw 60 is interlocked with the motor 81 of the rotary fan 8. Specifically, the hair care device 1 of this embodiment has a torque detector 82 on a motor shaft 8*a* to detect a torque of the motor 81 of the rotary fan 8. When the torque detected is zero or has a predetermined value, the microcomputer 90 determines that the rotary fan 8 has stopped rotating or the rotational speed thereof has decreased enough to protect fingers from injury even if the fingers touch the rotary fan 8. Thus, the microcomputer 90 controls to disengage the stopper claw 60 from the intake air filter 3. Various conventional torque detectors may be used as the torque detector 82. Also, the position of the torque detector may be selected according to the type of the torque detector.

Figure 15C:
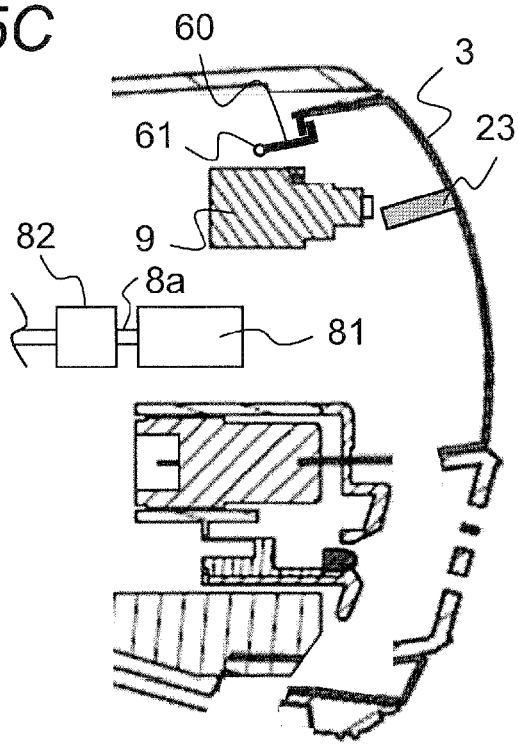
FIG. 15C is a see-through side view showing the detachment mechanism between the main body and the cover member of the hair care device according to Embodiment 6 of the present invention.
Figure 15D:
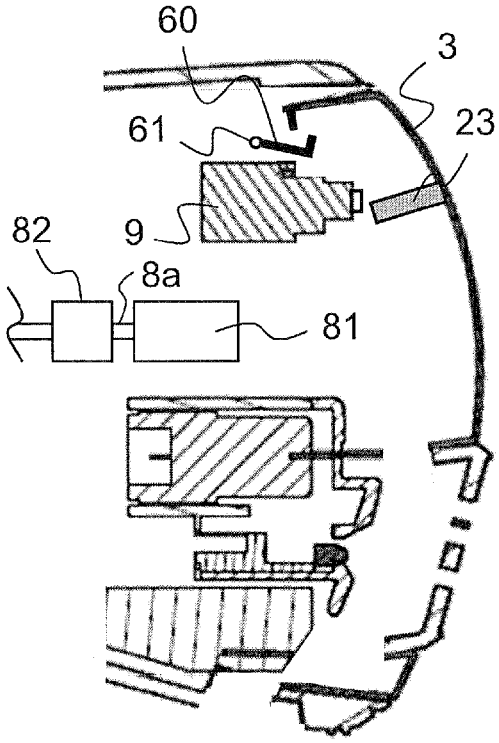
FIG. 15D is a see-through side view showing the detachment mechanism between the main body and the cover member of the hair care device according to Embodiment 6 of the present invention.

The mechanism as described above prevents the entire intake air filter 3 from being detached from the main body during an energized state of the device until after the rotary fan 8 completely stops even if the user tries to remove the intake air filter 3, although a lower half of the intake air filter 3 can be detached, as shown in FIG. 15C. This is because of the engagement between the stopper claw 60 and the intake air filter 3. In the state shown in FIG. 15C, the push switch 9 becomes open, and the detection of the torque of the rotary fan 8 is started under control of the microcomputer 90. Once the rotary fan 8 completely stops rotating or the torque value decreases to a value of zero or a predetermined desired value, the stopper claw 60 rotates around the rotation axis 61 downward so that the intake air filter 3 is allowed to be fully detached. In this way, safety of the user is ensured, as in Embodiment 5.

<Embodiment 7>

Figure 16:
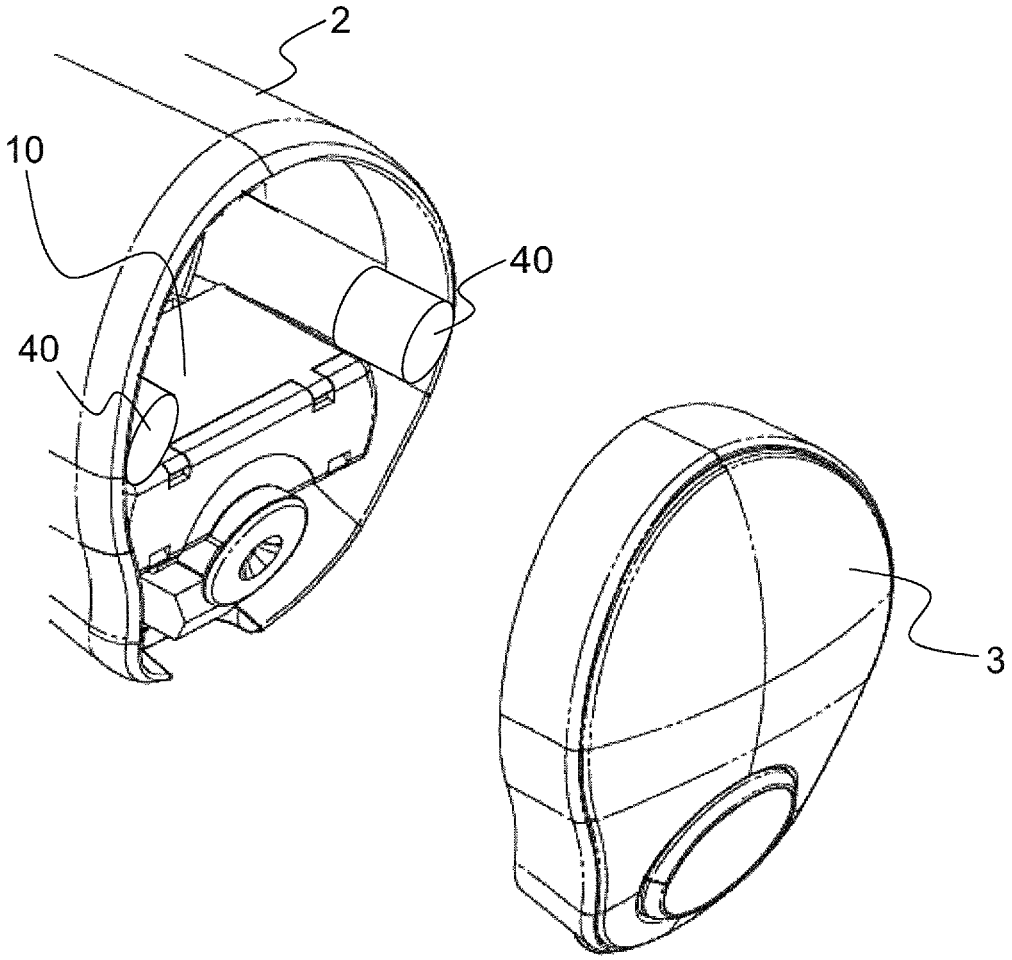
FIG. 16 is a perspective view showing a detachment mechanism between a main body and a cover member of a hair care device according to Embodiment 7 of the present invention.

FIG. 16 is a perspective view of a detachment mechanism between the main body 2 and the intake air filter 3, which is a cover member, of a hair care device according to Embodiment 7 of the present invention. Configuration and details shown in FIG. 16 may be applicable to any one of Embodiments 1-6 and any combination of these embodiments where it is appropriate or desired to do so.

In this embodiment, magnets 40 are used instead of the push switch 9. The magnets 40 are used in pairs, and called a magnet switch or a reed switch. The paired magnets 40 are arranged on the main body 2 and the intake air filter 3, respectively (the magnet 40 on the intake air filter 3 is not shown in the figure). While these magnets 40 are in contact with each other, the ion generator 10 is in an energized state. When the intake air filter 3 has been detached (i.e., the magnets 40 are not in contact with each other), the magnets 40 are separated from each other, so that the power supply of the ion generator 10 is turned off.

According to this embodiment, a mechanism having double functions of the power supply cut-off means and means of connecting the main body 2 and the intake air filter 3 is achieved. This allows for the cost reduction.

Instead of using a pair of magnets, one of the magnets may be a magnetic body that can be energized. Also, for the detachment mechanism using a magnet, a magnetic sensor may be used to detect change in the magnetic field according to closeness of the magnet, and power-on and -off of the ion generator 10 and other components may be performed under control of the microcomputer 90.

INDUSTRIAL APPLICABILITY

The present invention relates to a hair care device including a cover member for covering an opening in a main body of the hair care device, which cover member is removable for maintenance and replacement of parts inside the main body of the hair care device.

REFERENCE SIGNS LIST

1 nozzle
2 main body (hair care device main body)
3 intake air filter (cover member)
4 handle
5 hot air flow path
5*h* heater unit
6 cold air flow path
7 partition plate
8 rotary fan
8*a* motor shaft
9 push switch
10 ion generator
11 LED
12 ion generator board
13 low temperature mode switch
14 turbo on/off switch
15 power switch
16 needle electrode
17 dielectric electrode
18 protection mechanism
19 DC connector inlet
20 discharge port
21 recess
22 projection
23 projecting rod
30 ion detector
31 collection electrode
40 magnet
50 spring
51 supporting part (for securing the ion generator)
52 slide plate
53 support claw (for securing the ion generator)
60 stopper claw (for securing the suction filter)
61 rotation axis

70 foreign matter blocker
80 thread groove
81 motor
82 torque detector
90 microcomputer
91 electronic component case

What is claimed is:

1. A hair care device comprising:
a main body having a fan and a heater;
a handle attached to the main body;
a removable cover member configured to cover an opening of the main body; and
a power supply cut-off part configured to cut off a power supply when the cover member is detached from the main body; wherein
the main body includes an air outlet portion arranged on a front part of the main body; and
the removable cover member is a rear cover arranged on a rear part of the main body so as to be directly opposed to the air outlet portion of the main body.

2. The hair care device according to claim 1, wherein the power supply cut-off part is configured to cut off the power supply between a time at which a detaching operation of the cover member from the main body starts and a time at which the detaching operation is completed.

3. The hair care device according to claim 1, wherein the power supply cut-off part is configured to allow the main body to be energized upon attachment of the cover member to the main body.

4. The hair care device according to claim 1, further comprising a detector configured to detect that the cover member has been attached to the main body, wherein
the power supply cut-off part is configured to allow the main body to be energized after lapse of a certain time after the detector detects that the cover member has been attached to the main body.

5. The hair care device according to claim 1, further comprising an indicator configured to indicate an energized state of a component installed within the main body.

6. The hair care device according to claim 5, wherein the indicator is configured to be changed in its indication state when the component becomes inoperative.

7. A hair care device comprising:
a main body having a fan and a heater;
a removable cover member configured to cover an opening of the main body;
a power supply cut-off part configured to cut off a power supply when the cover member is detached from the main body; and
an indicator configured to indicate an energized state of a component installed within the main body;
wherein the component is an ion generator configured to generate ions, and the ion generator is arranged in a position in which the ion generator is exposed from the opening of the main body when the cover member has been detached from the main body.

8. The hair care device according to claim 7, further comprising an ion detector configured to detect a quantity of ions generated by the ion generator, and the indicator is configured to be changed in its indication state when the quantity of ions detected by the ion detector is below a predetermined value.

9. The hair care device according to claim 7, further comprising a foreign matter blocking section arranged downstream of the fan and between the fan and the ion generator, and configured to block foreign matter from passing therethrough.

10. The hair care device according to claim 7, further comprising:
a rail along which the ion generator is slidable;
a supporting part configured to secure the ion generator; and
a spring configured to push the ion generator toward the opening of the main body when the ion generator is disengaged from the supporting part.

11. A hair care device comprising:
a main body having a fan and a heater;
a removable cover member configured to cover an opening of the main body;
a power supply cut-off part configured to cut off a power supply when the cover member is detached from the main body; and
a detachment mechanism due to which a detaching operation of the cover member from the main body takes time sufficient to allow the fan to completely stop rotating by a time at which the detaching operation of the cover member from the main body is completed.

12. The hair care device according to claim 11, wherein the detachment mechanism comprises a thread groove provided on each of the main body and the cover member, and allows the cover member to be detached from and attached to the main body by rotation of the cover member relative to the main body.

13. The hair care device according to claim 11, wherein the detachment mechanism comprises a rotation detector configured to detect rotation of the fan and a stopper configured to suppress the detachment of the cover member from the main body, and when the rotation detector detects that the fan has completely stopped rotating, the cover member is disengaged from the stopper such that the cover member is allowed to be detached from the main body.

14. The hair care device according to claim 1, wherein the power supply cut-off part comprises a switch having a magnet.

15. The hair care device according to claim 1, wherein the power supply cut-off part comprises a push switch.

16. The hair care device according to claim 1, wherein a part or whole of the cover member forms an intake air filter.

* * * * *